United States Patent [19]

Panzner

[11] Patent Number: 4,995,618

[45] Date of Patent: Feb. 26, 1991

[54] MOVEABLE ROPING EXERCISE TARGET

[76] Inventor: Ty Panzner, Box 961, Dighton, Kans. 67839

[21] Appl. No.: 486,230

[22] Filed: Feb. 28, 1990

[51] Int. Cl.[5] ..... F41J 9/00

[52] U.S. Cl. ..... 273/367; 273/368; 273/370

[58] Field of Search ..... 273/367, 368, 369, 370

[56] References Cited

U.S. PATENT DOCUMENTS

| | | | |
|---|---|---|---|
| 2,792,224 | 5/1957 | White | 273/367 |
| 3,776,553 | 12/1973 | Kelton | 273/367 |
| 3,802,706 | 4/1974 | Hamm | 273/367 |

*Primary Examiner*—Benjamin Layno

*Attorney, Agent, or Firm*—John Wade Carpenter

[57] ABSTRACT

A device for animating a steer for use in the practice of roping a steer. The device has a pedestal member and a guide arm rotatably secured to the pedestal member. A frame is connected to the guide arm and is for supporting a motor for driving the frame. A surface engaging member is mounted to the frame and is adapted to effect movement of the frame along an operating surface. The motor is mounted to the frame and is operative coupled to the surface engaging member for driving the same. A first speed reduction assembly is engaged releasably to a clutch which is operatively connected to the motor. A second speed reduction assembly is operatively engaged to the first speed reduction assembly and to the surface engaging member.

11 Claims, 6 Drawing Sheets

FIG. 1
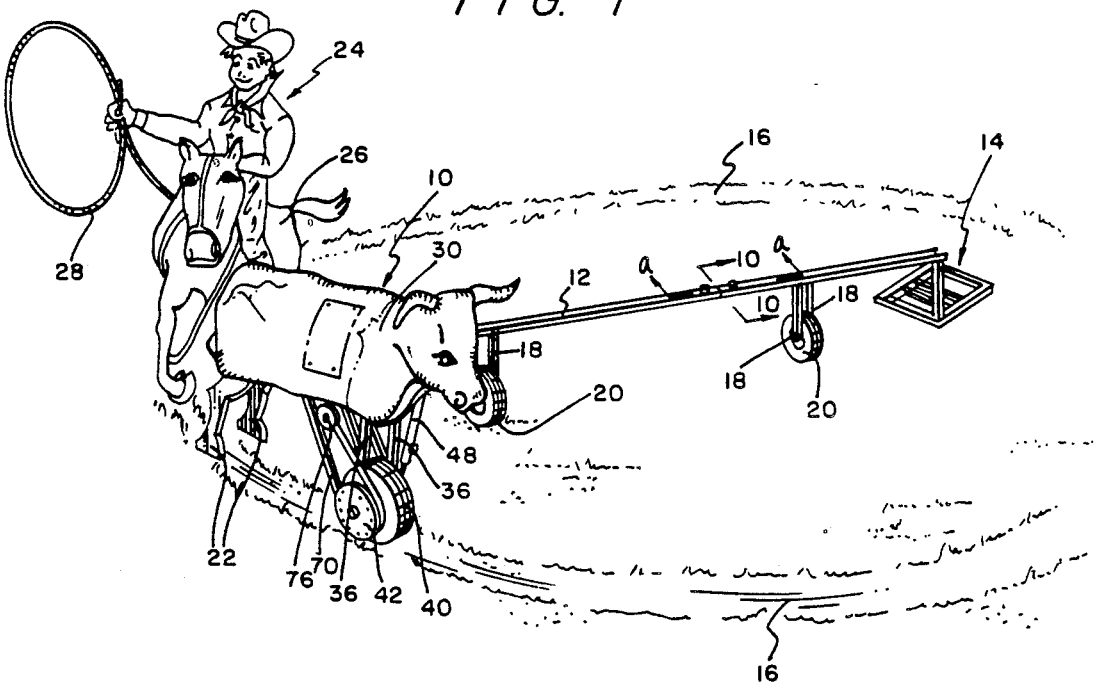
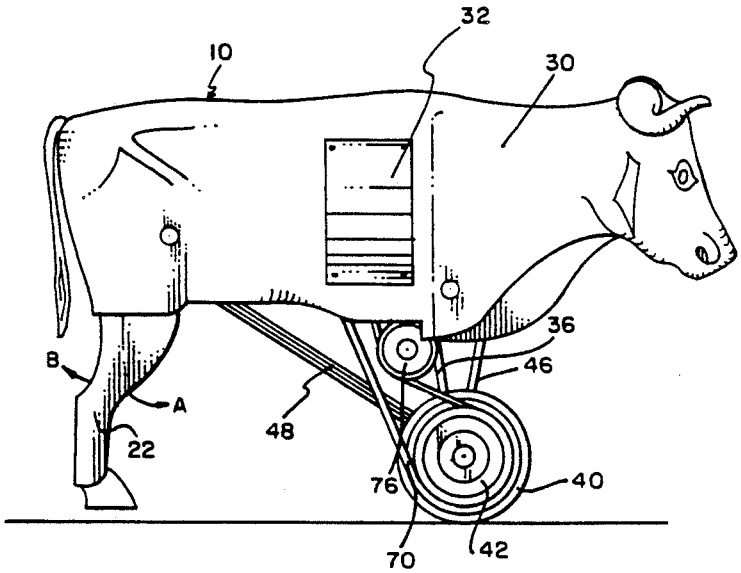
FIG. 2

FIG. 5
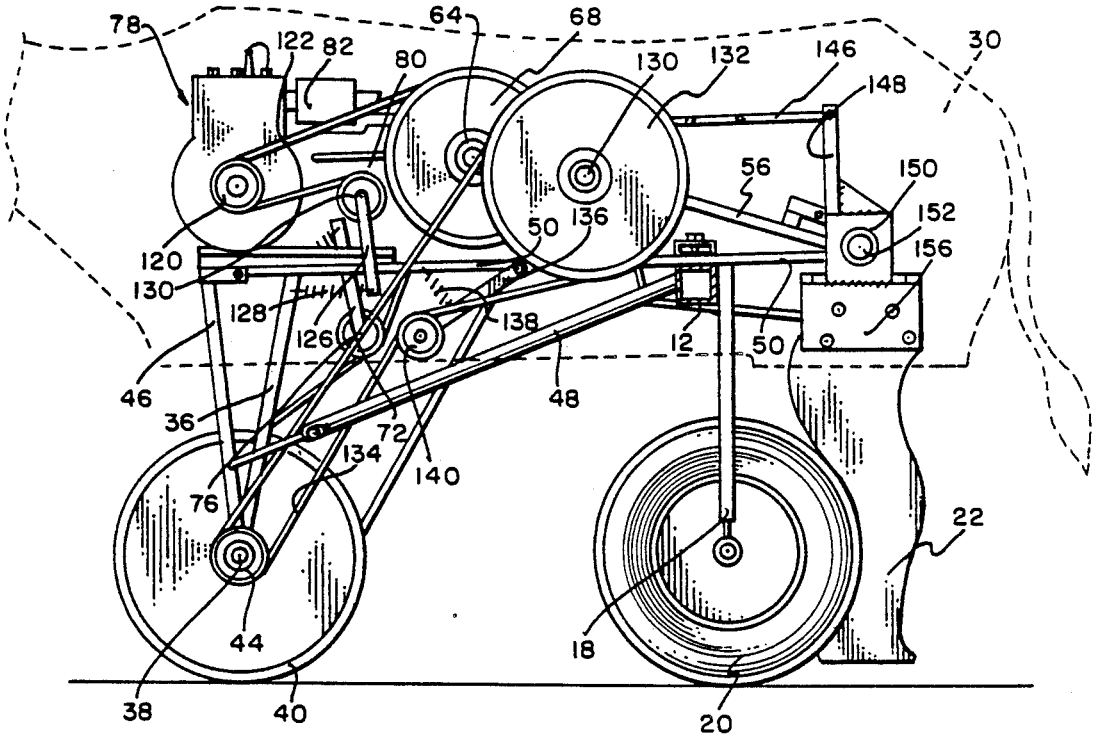
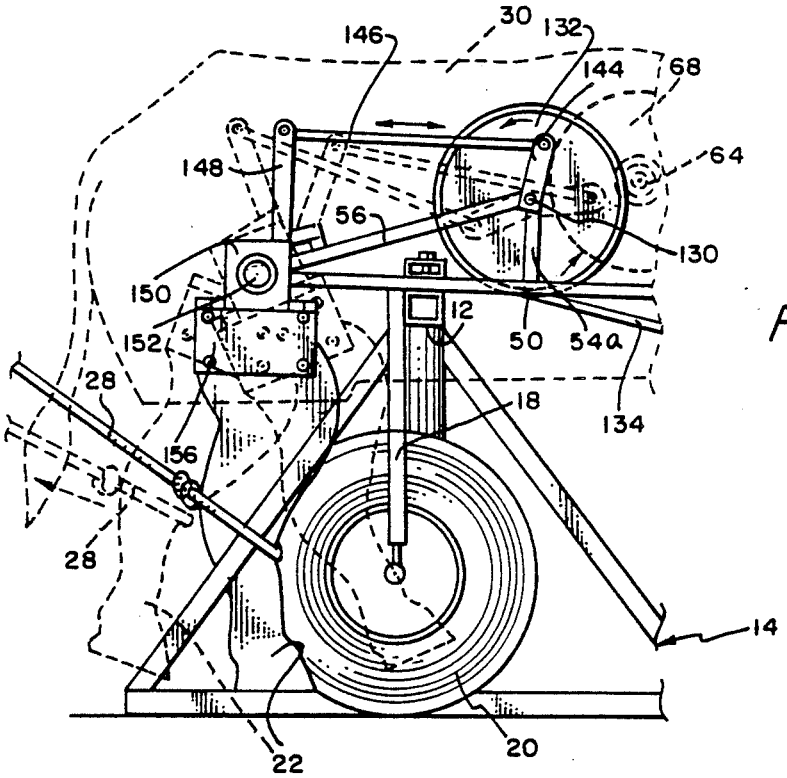
FIG. 6

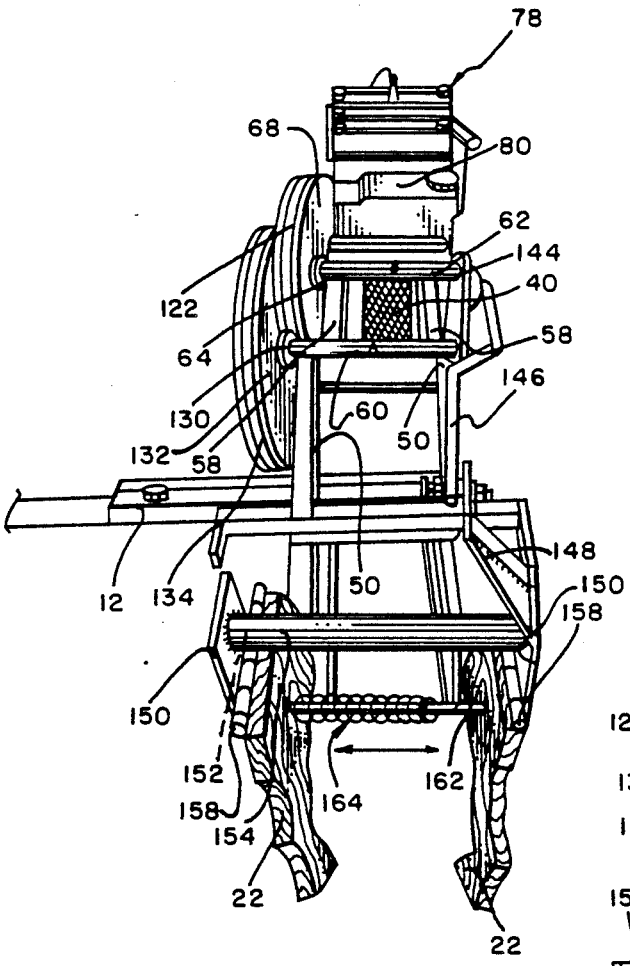
FIG. 11
FIG. 12
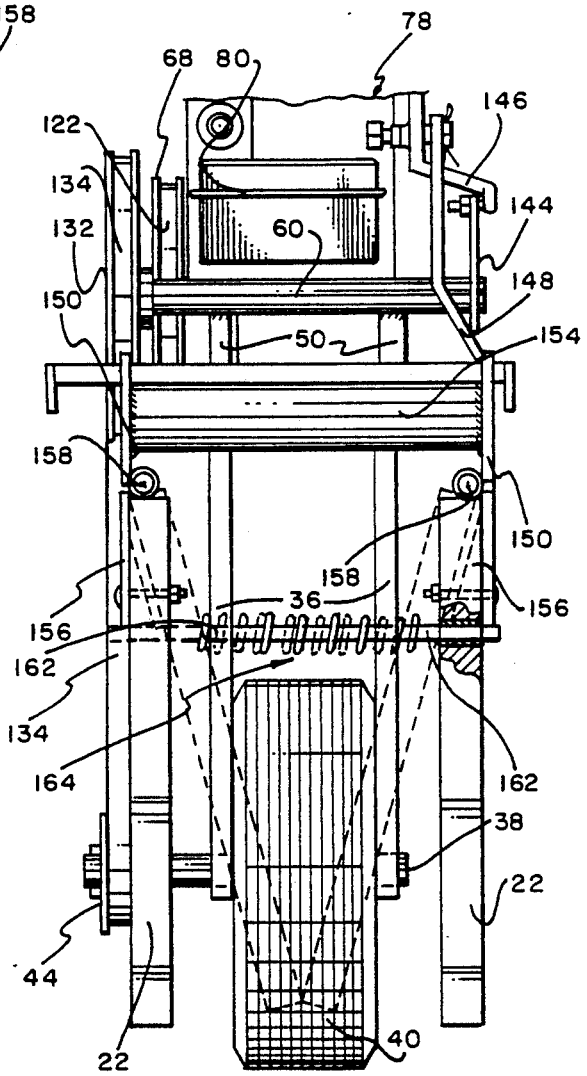
FIG. 14
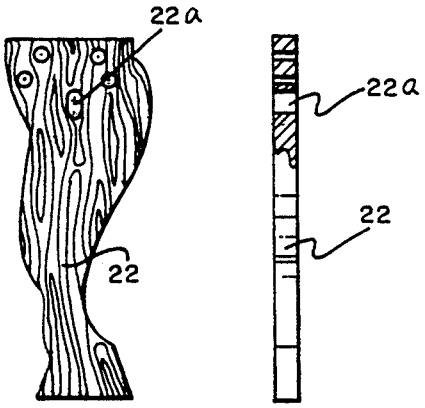
FIG. 13

MOVEABLE ROPING EXERCISE TARGET

BACKGROUND OF THE INVENTION

1. Field of the Invention

This invention relates to a moveable roping exercise target. More specifically, this invention provides a device animating a steer for use in practicing roping a steer.

2. Description of the Prior Art

A patentability investigation was conducted and the following U.S. patents by numbers were discovered: No. 3,776,553 to Kelton; No. 3,802,706 to Hamm; No. 2,819,900 to Brackett; No. 3,324,832 to McCain; and No. 4,286,788 to Simington et al. None of the foregoing prior art U.S. patents teach or suggest the particular moveable roping exercise target are of the present invention.

SUMMARY OF THE INVENTION

The present invention broadly accomplishes its desired objects by providing a device animating a steer. The device comprises a pedestal member; and a guide arm rotatably secured to the pedestal member. A frame means is provided for supporting a drive means for driving the frame means. The frame means is connected to the guide arm. A surface engaging means is mounted to the frame member and is adapted to effect movement of the frame means along an operating surface. A drive means is mounted on the frame means and is operatively coupled to the surface engaging means for the driving the same. The drive means includes a power means supported by the frame means for effecting movement of the surface engaging means. A clutch is operatively connected to the power means. The device further includes a first speed reduction assembly engaged releasably to the clutch, and a second speed reduction assembly operatively engaged to the first speed reduction assembly and to the surface engaging means. At least one leg means is pivotally supported on the frame means for swinging backwards and forward to simulate a leg of a moving live cow or steer. A leg drive assembly is operatively engaged to the leg means and to the surface engaging means such that as the surface engaging means moves, the leg means swings backwards and forwards.

The first speed reduction assembly comprises a first sheave having a first diameter and releaseably engaged to the clutch. A second sheave is provided as having a second diameter that is larger than the first diameter and rotatably supported by the frame means. An endless belt is entrained to the first sheave and to the second sheave. The first speed reduction assembly further comprises a first spring biased lever pivotally secured to the frame means and a first idler sheave rotatably secured to the first spring biased lever and engaged to the endless belt.

The second speed reduction assembly comprises a third sheave coupled to the second sheave to be rotatable therewith. The third sheave has a third diameter. The second speed reduction assembly further comprises a fourth sheave having a fourth diameter larger than the third diameter and coupled to the surface engaging means such that when the fourth sheave is caused to be turned, the surface engaging means moves along an operating surface. An endless belt is entrained over the third sheave and the fourth sheave. The second speed reduction assembly further comprises a second spring biased lever pivotally secured to the frame means and a second idler sheave rotatably secured to the second spring biased level and engaged to the endless belt that is entrained over the third sheave and the fourth sheave.

The leg drive assembly comprises a sheave coupled to the surface engaging means such that when the surface engaging means is caused to be turned the sheave turns therewith. The leg drive assembly further comprises another sheave that is rotatably supported by the frame means. A crank member is coupled to the other sheave such as to be rotatable therewith. A linkage member is pivotally secured to the crank member and to the leg means.

It is therefore an object of the present invention to provide a device animating a steer and to be used as a moveable roping exercise target.

This, together with the various ancillary objects and features which will become apparent to those skilled in the art as the following description proceeds, or attained by this novel moveable roping exercise target, a preferred embodiment being shown with reference to the accompanying drawings, by way of example only, wherein;

BRIEF DESCRIPTION OF THE DRAWINGS

FIG. 1 is a perspective view disclosing the device animating a steer with a cowboy in pursuit thereof;

FIG. 2 is a side elevational view of the device animating a steer;

FIG. 5 is a another side elevational view of the device of the device animating a steer;

FIG. 6 is a partial side elevational view of the device with dotted lines representing the forward and backward movement of the legs and the forward and backward movement of the linkage member that drives the legs;

FIG. 11 is a perspective top plan view of the device animating a steer without the body;

FIG. 12 is an end elevational view of the device with the dotted line representing the inward pivotal movement of the rear legs;

FIG. 13 is a side elevational view of a leg;

FIG. 14 is a front elevational view of a leg;

DETAILED DESCRIPTION OF THE INVENTION

Figure 15:
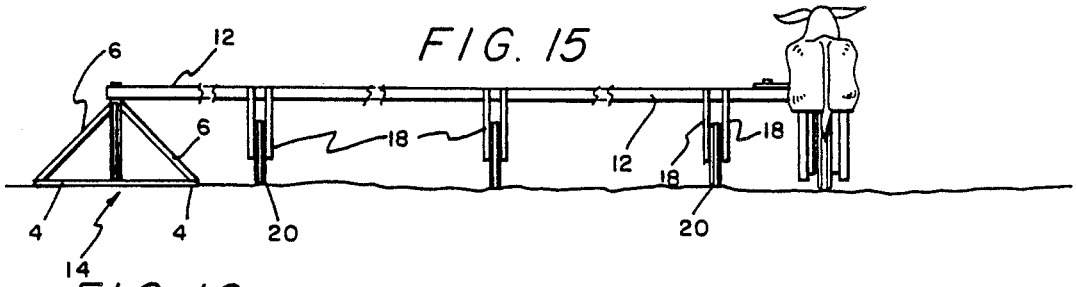
FIG. 15 is an end elevational view of the device animating a steer.
Figure 16:
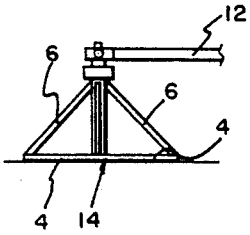
FIG. 16 is a partial front elevational view of the pedestal member engaged to the guide arm.
Figure 17:
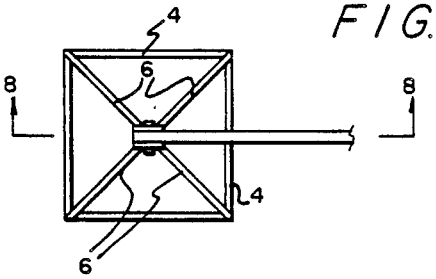
FIG. 17 is a partial top plan view of the pedestal in FIG. 16.

Referring in detail now to the drawings wherein similar elements of the invention are identified by like reference numerals, there is seen a mechanical self-propelling animated steer, generally illustrated as 10, having a guide arm 12 connected thereto. The guide arm 12 is also rotatably connected to a stationary member, generally illustrated as 14. The guide arm 12 radially extends out from the stationary member 14 such as to cause the steer 10 to traverse a circular path 16 as it self-propels in the circular path 16 over the undulated surface of the terrain upon which the steer 10 and stationary member 14 are installed. The stationary member 14 is pyramidal in shape having square shaped base supports 4-4-4-4, and sloping side supports 6-6-6-6 extending from the corners of the square shaped base supports 4-4-4-4 to the top of a sleeve 9 surrounding a pivotally lodged central support 8 to which the guide arm 12 connects (see FIGS. 7, 8, 15 and 16). Subtending the guide arm 12 between the stationary member 14 and the steer 10 is at least one pair of frame members 18—18, preferably three pair of frame members 18—18 as best shown in FIG. 15. Rotatably mounted to each pair of frame members 18—18 is a wheel 20. The steer 10 has a pair of legs 22—22 that swing in a pendulum fashion in direction of the arrows A and B in FIG. 2 as the steer 10 self-propels along the circular path 16. Stated alternatively the legs 22—22 move forward and rearwardly while the steer 10 is in motion. A cowboy 24 on a horse 26 chases the self-propelling steer 10 and ropes the pendulum swinging legs 22—22 with a lariat 28. As will be explained in greater detail below, when the legs 22—22 are roped and pulled rearward and upwardly, the steer 10 stops self-propelling and becomes stationary. Stated, alternatively, when the cowboy 24 pulls the roped legs 22—22 rearwardly and upwardly with the lariat, the steer 10 stops, and there is no movement in the circular path 16.

The steer 10 has a hollow body 30, which may be manufactured of any suitable material such as plexiglass. The body 30 is provided with a removable door 32 in order to obtain access into the internals of the mechanical animated steer 10. The body 30 of the steer is removably secured to a frame member, generally illustrated as 34. The frame member 34 is provided near its front end with a pair of vertically depending spaced support bars 36—36. The vertical depending support bars 36—36 are held in spaced parallel relationship to each other by means of a rotatable axle shaft 38 which is adapted to support in a rotative relationship, a rubber tired rotatable road wheel 40 is connected to the rotatable axle shaft 38 that when such that when the axle shaft 38 is caused to be turned, the wheel 40 turns. Fixed to the axle shaft 38 in an opposed relationship on different sides of the wheel 40 is a pulley wheel 42 and a rotary take-off sheave 44. As illustrated, sheave 44 has a smaller diameter than wheel 42 and functions to provide rotary power such that, as will be more fully described below, causes the legs to swing in the pendulum fashion. The pulley wheel 42 functions to provide rotary motion to the axle shaft 38 which in turn causes the road wheel 40 to turn for propelling the steer 10 on the circular path 16. At least one vertical support bar 46 connects from the frame member 24 to one of the support bars 36. A support rod 48 connects from the mid point of the bar 36 to the guide arm 12.

The frame member 34 has a pair of horizontal supports 50—50 to which the spaced bars 36—36, the support bar 46, and the guide arm 12 connect. The frame member 34 also has an upper frame assembly, generally illustrated as 52, comprising rear upright supports **54*a*—54*a* and front upright supports 54*b*—54*b* secured to each of the horizontal supports 50, making a total of four supports identified as 54*a*, 54*a*, 54*b* and 54*b*. The frame assembly 52 also has a pair of sloping supports 56—56 respectively attached to the horizontal supports 50—50 and gradually rising and connecting to the rear upright supports 54*a*—54*a*. Interconnecting one rear upright support 54*a* with a front upright support 54*b* and with a sloping support 56 is bridge support 58, thus providing a total of two bridge supports 58—58. A rear conduit member 60 is bound to and supported by the rear upright supports 54*a* and 54*a*, the sloping supports 56—56, and the two bridge supports 58—58. Similarly, a front conduit 62 is bound to and supported by the front upright supports 54*b*—54*b* and the two bridge supports 58—58**.

Figure 3:
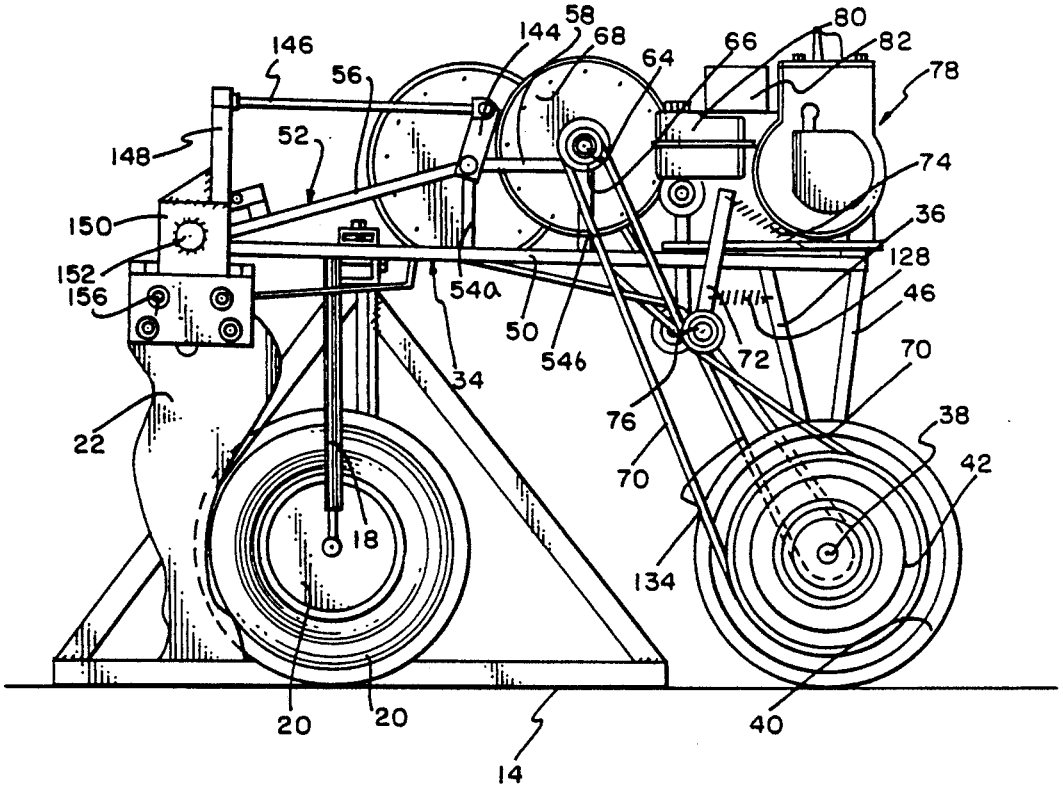
FIG. 3 is a side elevational view of the device animating a steer without the steer body covering the same.
Figure 4:
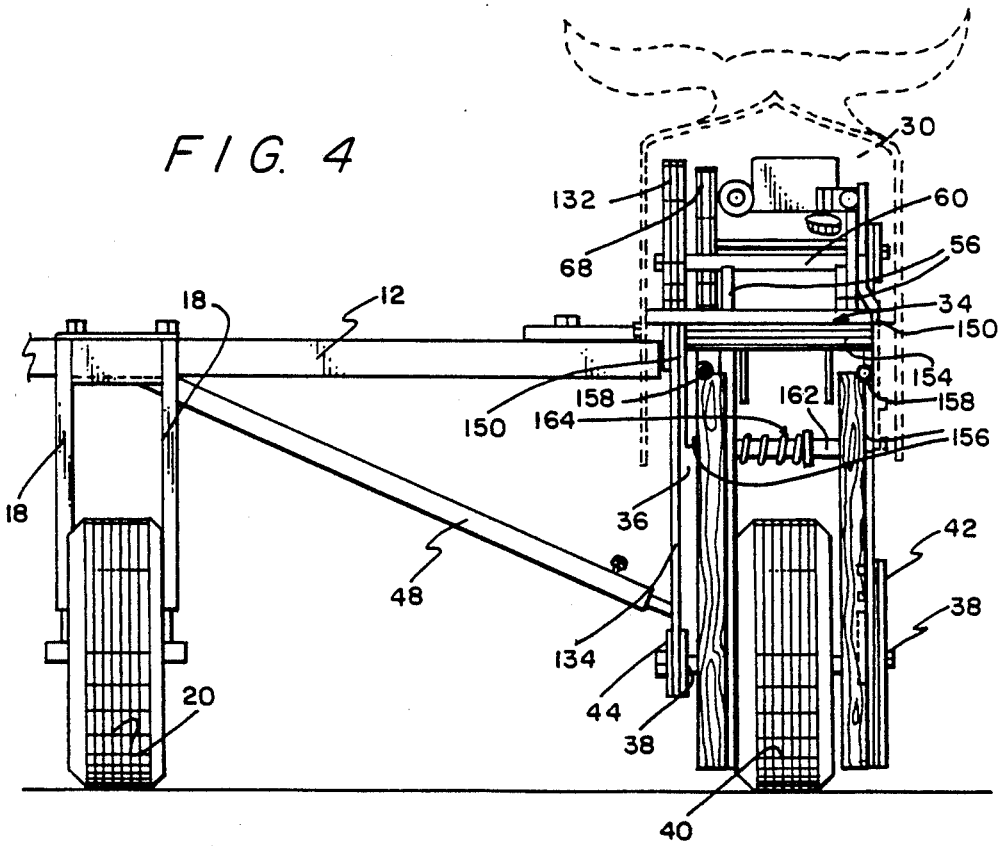
FIG. 4 is a rear elevational view of the device in FIG. 3.
Figure 7:
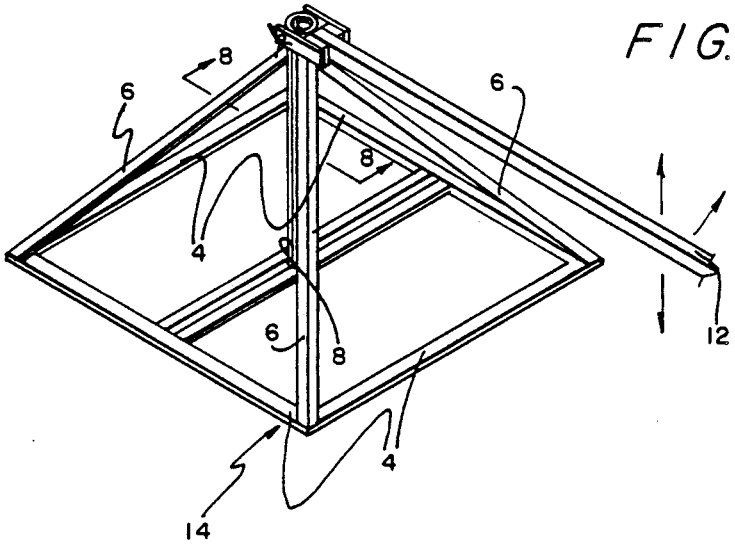
FIG. 7 is a perspective view of the pedestal member.
Figure 8:
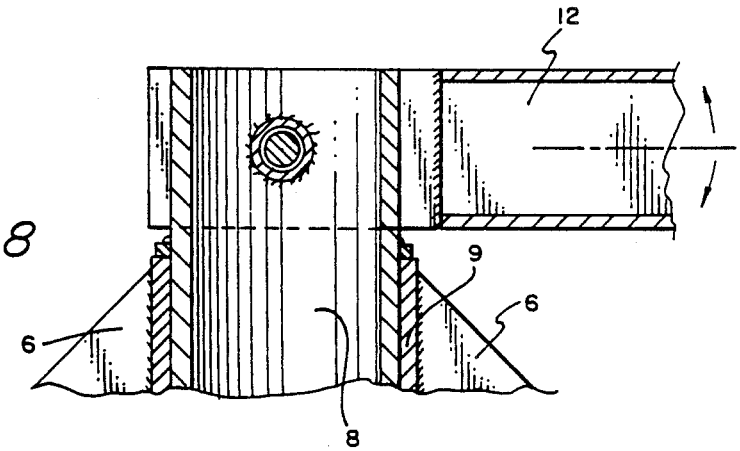
FIG. 8 is a partial vertical sectional view taken in direction of the arrows and along the plane of line 8—8 in FIG. 7.
Figure 9:
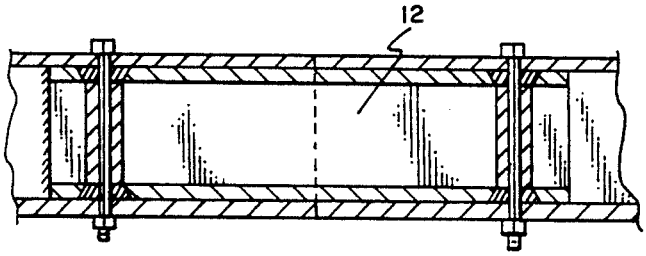
FIG. 9 is a vertical sectional view taken in direction of the arrows and along the plane of line 9—9 in FIG. 1.
Figure 10:
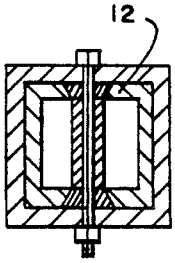
FIG. 10 is a vertical sectional view taken in direction of the arrows and along the plane of line 10—10 in FIG. 1.

Rotatably extending through the front conduit 62 is a front axle 64. Bound to one end of the front axle 64 is a sheave (or pulley) 66, and attached to the other end of the front axle 64 is sheave 68. As best shown in FIG. 3, sheave 68 and sheave 66 are both generally concentric with respect to each other and the axle 64 and sheave 66 rotate when sheave 68 is rotated or caused to be rotated. As further best shown in FIG. 3, sheave 68 has a larger diameter than sheave 66. Entrained around sheave 66 and the pulley wheel 42 is an endless belt 70 such that as sheave 66 is rotated, pulley wheel 42 rotates causing the wheel 40 to rotate and start the steer 10 in its circular path 16. Pivotally secured to one of the horizontal supports 50 is a lever 72 which is spring biased towards the rear of the steer 10 by a spring 74 that attaches from the top of the lever 72 to the horizontal support 50. Rotatably connected to the bottom of the lever 72 is an idler sheave 76 that engages the endless belt 70 to take-up the slack and/or maintain tension on belt 70, especially between the periods of time when the steer 10 is motionless and the time its traversing the circular path 16.

Figure 18:
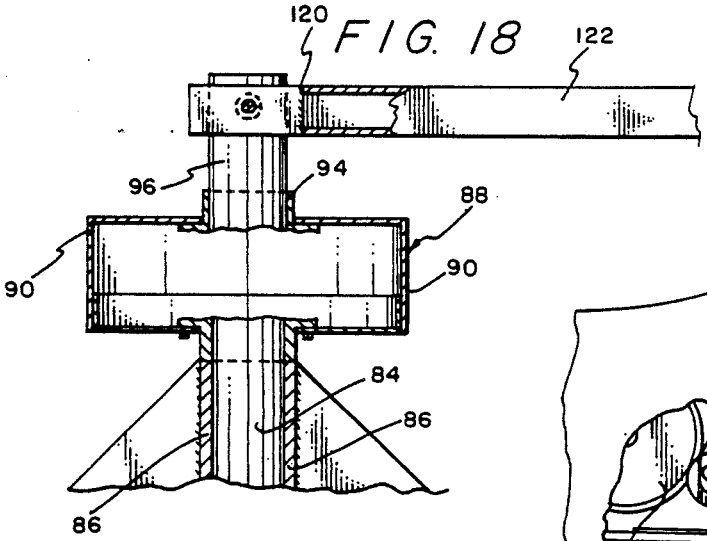
FIG. 18 is a top plan view of the motor shaft engaged to a centrifugal clutch.
Figure 19:
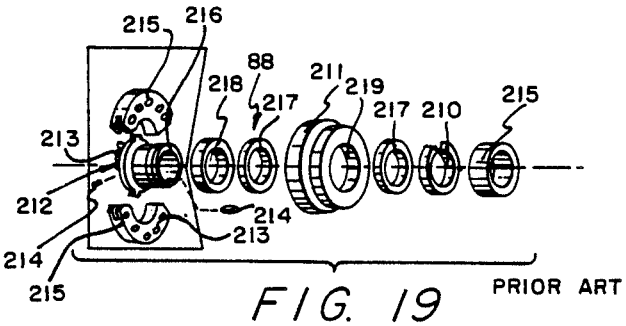
FIG. 19 PRIOR ART
FIG. 19 is a disassembled view of the centrifugal clutch employed in the animated steer device of this invention.
Figure 20:
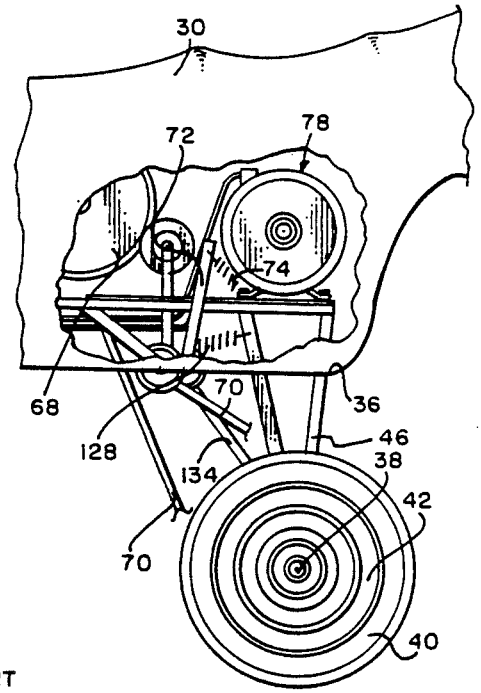
FIG. 20 is a partial side elevational view of the animated steer device of this invention.

A power means or motion, generally illustrated as 78, is connected to and supported by the frame member 34, more specifically the horizontal supports 50—50. The motor 78 may be any suitable means for driving and self-propelling the steer, such as an electrical motor or a mechanical motor as shown in the drawings having a gas reservoir 80, a carburetor 82, etc. Motor 78 imports rotatory motion to a motor shaft 84 (see FIG. 18) which is housed in a sleeve 86. Attached at one end of the sleeve 86 is a conventional centrifugal clutch, generally illustrated as 88, having a clutch housing 90 secured to the sleeve 86. The clutch housing 90 is also mounted to a sleeve bearing 94 wherethrough a shaft 96 rotatably passes. The conventional centrifugal clutch 88 may be any type of centrifugal clutch 88 that acts on centrifugal force and would transfer and/or couple rotary motion from one shaft (i.e. shaft 84) to another shaft (i.e. shaft 96) upon or with increase of the revolutions per minute of the one shaft (i.e. shaft 84). At lower revolutions per minute there is no transfer of rotary motion since there is not enough centrifugal force. The centrifugal clutch 88, is best shown in FIG. 19, comprises pulley drum 211 (end sheave), a motor assembly, generally illustrated as 212, a pair of springs 213—213, and a set screw 214. The pair of springs 213—213 are engaged respective to pair of shoes 215—215 and to a hub 216. As the speed of hub 216 increases, the shoes 215—215 expand outward to engage the pulley drum 211. Hub 216 is typically coupled to motor shaft 84. The conventional clutch 88 also includes a spacer 218, washers 217—217, a bushing 219, a ring 210, a steel collar 215 and a key 214. Steel collar 215 and/or pulley drum 211 would typically be coupled to shaft 96.

Connected to the end of the shaft 96 a pulley 120 that revolves with the shaft 96. Entrained over and/or around pulley 120 and sheave 68 is an endless belt 124. Pivotally attached to a horizontal support 50 is a lever 126 (see FIG. 5) which is normally biased at one end towards the front of the steer 10 by a spring 128 that is connected to a bar 36 and the biased end of the lever 126. Rotatably connected at the other end of the lever 126 is an idler sheave 130 which is normally urged towards the rear of the steer 10 by the spring 128. Idler sheave 130 engages the endless belt 122 to maintain tension and/or take up the slack on belt 122, especially between the periods of time when the steer 10 is moving in the circular path 16 and the time when the steer 10 is not moving at all. Pulley 120, sheave 68, and the idler sheave 130 including its associated pivotal spring biased lever 126 (and spring 128) form part of a speed reduction assembly since the diameter of the pulley 120 is smaller than the diameter of the sheave 68, as best illustrated in FIG. 5. Thus, sheave 68 will have less revolutions per minute than pulley 120. Stated alternatively, pulley 120 will make or turn more revolutions per minute than sheave 68, and axle 64 will make or turn less revolutions per minute than shaft 96. The front axle 64, pulley 66, endless belt 70, and wheel 42 also form the speed reduction assembly along with lever 72, spring 74 and idler sheave 76. The speed reduction assembly functions to proportionately lower and decrease the number of revolutions for axle shaft 38 per each revolution of shaft 84 and/or shaft 96. Started alternately, shaft 84 and/or 96 turn more revolutions per minute than axle shaft 38 and the road wheel 40. Without the speed reductions assembly the axle shaft 38 could turn the same number of revolutions per minute as the shafts 84 and/or 96 which would cause the steer 10 to move or travel too fast in the circular path 16.

Rotatably extending through the rear conduit 60 is a rear axle 130. Bound to one end of the rear axle 130 is a sheave 132. An endless belt 134 is entrained around the take-off sheave 44 and the sheave 132 and function to transfer rotary power from the sheave 44 to the sheave 132. Sheave 44 has a smaller diameter than sheave 132; thus, sheave 44 will turn or rotate more revolutions per minute than sheave 132. Stated alternatively, sheave 132 will turn or rotate less revolutions per minute, and axle shaft 38 will turn or rotate more revolutions per minute than rear axle 130. A lever 136 is pivotally attached at one of its end to one of the horizontal support 50. A spring 138 is connected to the horizontal support 50 and to the lever 136 to bias the lever 136 upwardly and towards the horizontal support 50. An idler sheave 140 is rotatably mounted to the other end of the lever 136 and engages the endless belt 134 to main tension (or take-up the slack) on same, especially between the periods of time when the steer 10 is motionless and the time it's traversing the circular path 16.

Bound to another end of the rear axle 130 is a crank member 144 (see FIG. 6) which rotates with the rear axle 130. As the rear axle 130 revolves 360 degrees, the crank member 144 also revolves as such or 360 degrees. A linkage member 146 at one of its ends is pivotally secured to the crank member 144. At the other end of the linkage member 146 an arm member 148 is pivotally attached. The arm member 148 is bound to an upper plate member 150. Upper plate member 150 is opposed to another upper plate member 150 to provide two opposed upper plate members 150—150 which are both bound to a transverse shaft 152 that rotates through a tubular housing 154 (see FIG. 11) which is bound to and supported by the horizontal supports 50—50. Transverse shaft 152 and the pair of upper plate members 150—150 bound thereto turn or move simultaneously and/or in unison. A lower plate members 156 is hinged at 158 to each of the upper plate member 150—150 to pivotally connect to each of the upper plate members 150—150. Thus, there are two lower plate members 156—156 which respectively connect pivotally to an upper plate member 150 such as to pivot inwardly towards each other. The pair of legs are respectively connected to a lower plate member 156 such as to be capable of pivoting and moving inwardly towards each other with the lower plate members 156—156. Passing slidably into and through an aperture **22*a* in each leg 22 (as best illustrated in FIGS. 11 and 12 and 13 and 14) is a spring support shaft 162. Surrounding the shaft 162 and generally centrifugal therewith is a compression spring assembly 164 which functions to return the legs 22—22 to a parallel posture when the legs 22—22 are released after being collapsed and/or pivoted towards each other on shaft 162, such as when lassoed with lariat 28 (see FIG. 6). As sheave 44 turns with axle shaft 38, the endless belt 134 causes sheave 132 to rotate which in turn cause the rear axle 130 to also rotate within the rear conduit 60. As indicated previously, the crank member 144 also rotates with the rear axle 130. As the crank member 144 revolves, the linkage member 146 reciprocates back and forth as shown in the dotted line representation in FIG. 6. With the reciprocation of the linkage member 146, arm member 148 is driven forward and backward as also shown in the dotted line representation in FIG. 6. One of the upper plate members 150 bound to the arm member 148 moves with the arm member 148, which in turn moves the transverse shaft 152 causing the other upper plate member 150 to move therewith. As the arm member 148 moves forward, the associated upper plate member 150 rotates clockwise, with the other, opposed upper plate 150 secured to shaft 152 also moving therewith. This movement causes the respective pivotally connected lower plate members 156—156, along with their respective associated depending legs 22—22, to move or partially rotate backward and towards the rear of the steer 10. Similarly, as the arm member 148 moves backward, the associated upper plate member 150 rotates counterclockwise, with the other, opposed upper plate member 150 secured to shaft 152 also moving therewith. This movement causes the respective pivotally connected lower plate members 156—156, along with their respective associated depending legs 22—22, to move or partially rotate and swing forward and towards the front of the steer 10. Thus, the forward and rearward movement of the arm member 148 caused by the crank 144 and the linkage member 146 and more broadly by the self-propelled movement of the steer 10, produces the swinging of the legs 22—22 in a pendulum fashion and in direction of the arrows A and B in FIG. 2**.

Continuing to refer in detail to the drawings for operation of the invention, the motor 78 is energized and allowed to idle until the cowboy 24 is ready to ride and lasso the pendulum-like kicking legs 22—22. In the idling position, the shaft 84 and the attached centrifugal clutch 88 are not revolving fast enough and with sufficient revolutions per minute to cause the revolving centrifugal clutch to overcome tension springs 213 and 88 engage shaft 96 to a transfer rotary power or motion from the revolving shaft 84 to the shaft 96 whereto pulley 120 is mounted. When the cowboy 24 is ready, the motor 78 is throttled upwardly such that the revolutions per minute on shaft 84 increases. The increase in centrifugal force created by a faster revolving shaft 84 causes a revolving centrifugal clutch 88 to overcome the tension provided by springs 213 thus engaging shaft 96 to start the same rotating. Pulley 120 also starts rotating and rotary motion is transferred to sheave 68 via belt 122 at a much reduced rotating or revolving speed. The amount of reduction is proportional to the ratio of the diameter of sheave 68 to the diameter of pulley 120. As sheave 68 turns, its associated bound front axle 64 also turns, causing sheave 64 to also turn and revolve. When sheave 64 starts revolving, the entrained belt 70 engaged around sheave 64 and pulley wheel 42 transfer rotary motion from sheave 64 to the pulley wheel 42 such that pulley wheel 42 starts turning along with the connected axle shaft 38. The turning of axle shaft 38 causes the bound road wheel 40 to turn and the steer 10 commences the movement in the circular path 16.

As the axle shaft 38 revolves, the connected rotary take-off sheave 44 also revolves. The endless belt 134 transfers rotary motion from a revolving sheave 44 to the sheave 132. As previously indicated, when sheave 132 revolves and turns, the connected rear axle 130 rotates, causing the attached, associated crank member 144 to also rotate (all in a 360 degree arc). The linkage member 146, pivotally secured to the crank member 144, transfers a 360 degree movement on the crank member 144 at one end of the linkage member 146 into a forward and backward movement on the arm member 148 at the other end of the linkage member 146. The forward/backward movement of the arm member 148 causes an alternating clockwise and counterclockwise movement on an upper plate member 150 which transfers the same movement to the other opposed upper plate member 150 through the associated, bound shaft 152. As both upper plate members 150—150 rocks back and forth in an alternating clockwise/counterclockwise movement about the axis of shaft 152, the pivotally connected lower plate members 156—156 swing back and forth, causing the legs 22—22 to move and swing forward and backward in a pendulum fashion. As long as the steer 10 continues to move in the circular path 16, the legs 22—22 swing backward and forward in direction the arrows A and B in FIG. 2.

The object for the cowboy 24 is to rope or lasso the legs 22—22 with the lariat 28. When the cowboy 24 has roped at least one leg 22, preferably both legs 22—22, the leg 22 or legs 22—22 are pulled backward in direction of the dotted arrow in FIG. 6, causing the arm member 148 to pivot forward and drive the linkage member 146 also forward. If both legs are roped by the lariat 28, its legs slidably move along shaft 162 and collapsed together in the dotted line position of FIG. 12. As the linkage member 146 drives forward and is held and locked into the forward furthermost position by the cowboy 24 pulling backward and upward on legs 22—22, the crank member 144 is jammed forward and locked into a forward furthermost position and cease rotating. When the crank member 144 is jammed forward and held as such by the cowboy 24 continually pulling upward and backward on a leg 22 or legs 22—22, sheave 132 stops rotating, causing an increase drag on pulley 44 since pulley 44 is continually turning (as long as steer 10 is moving) and attempting to move belt 134 around a non-turning sheave 132. Because sheave 132 is not turning, a frictional drag is created by the belt 134 being moved partially around the circumference of the sheave 132 by pulley 44. Increase drag on pulley 44 starts slowing down a revolving road wheel 40, which in turn transfers this reduction in revolutionary movement to wheel 42, to sheave 64 via belt 70 and the wheel 42, to sheave 68 via the front axle 64, and to pulley 120 via the belt 122 and sheave 68. Retarding the revolution of pulley 120 increases the load and/or drag on motor 78, causing a decrease in the revolutions per minute of shaft 96, the centrifugal clutch 88, and the shaft 84. The load and/or drag on motor 78 is also increased by the cowboy 24 pulling upward and backward on the leg 22 or legs 22—22, or by the cowboy 24 with the assistance of his horse pulling back on lariat 28 with sufficient force to completely stop the steer 10. As the revolutions per minute of shaft 96 decreases, the centrifugal clutch 88 disengages from shaft 96 to stop shaft 96 from revolving. The steer 10 is now motionless and is not traversing to circular path 16. After the cowboy 24 releases the lariat 28 from around the leg 22 or legs 22—22, the centrifugal clutch 88 will revolve with a sufficient number of revolutions per minute to couple a revolving shaft 84 with the shaft 96 to start the movement of the steer 10 again, and to start the swinging of the legs 22—22 in the pendulum fashion and in direction of the arrows A and B in FIG. 2. The cowboy 24 may now rope the leg 22 or legs 22—22 again and start the process all over again. Thus, the self-propelling steer 10 of this invention provides a mechanical device for a cowboy 24 to practice roping the pendulum swinging legs 22—22 which simulate the legs of a real cow or calf.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A device animating a steer comprising a pedestal member; a guide arm rotatably secured to said pedestal member; a frame means, connected to said guide arm, for supporting a drive means for driving the frame means; a surface engaging means mounted to said frame member and adapted to effect movement of said frame means along an operating surface; drive means mounted on said frame means and operatively coupled to said surface engaging means for driving same, said drive means includes a power means supported by said frame means for effecting movement of the surface engaging means, a clutch operatively connected to said power means, a first speed reduction assembly engaged releasably to said clutch, and a second speed reduction assembly operatively engaged to said first speed reduction assembly and to said surface engaging means.

2. The device of claim 1 additionally comprising at least one leg means pivotally supported on said frame means for swinging backward and forward to simulate a leg of a moving live cow.

3. The device of claim 2 additionally comprising a leg drive assembly operatively engaged to the leg means and to the surface engaging means such that as the surface engaging means moves to the leg means swings backward and forward.

4. The device of claim 1 wherein said leg drive assembly comprises a first sheave coupled to said surface engaging means such that when said surface engaging means is caused to be turned said first sheave turns therewith, said first sheave having a first diameter; a second sheave rotatably, supported by said frame means and having a second diameter; a crank member coupled to said second sheave such as to be rotatable therewith; and a linkage member pivotally secured to said crank member and to said leg means.

5. The device of claim 4 wherein said second diameter is larger than said first diameter.

6. The device of claim 4 wherein said leg means comprises an arm member pivotally secured to said linkage member, an upper plate member connected to said arm member, a shaft member rotatably supported by said frame means and bound to said upper plate member, a lower plate member connected to pivotally said upper plate member and a leg member connected to said lower plate member.

7. Device of claim 2 said leg means comprises a pair of legs, and a spring biasing means for biasing said pair of legs away from each other such that the legs are compressible towards each other.

8. The device of claim 1 wherein said first speed reduction assembly comprises a first sheave having a first diameter and releasably engaged to said clutch, a second sheave having a second diameter that is larger than said first diameter and rotatably supported by said frame means, and a first endless belt entrained to said first sheave and to said second sheave.

9. The device of claim 8 wherein said first speed reduction assembly comprises a first spring biased lever pivotally secured to said frame means and a first idler sheave rotatably secured to said first spring biased lever and engaged to said first endless belt.

10. The device of claim 9 wherein said second speed reduction assembly comprises a third sheave coupled to said second sheave to be rotative therewith, said third sheave having a third diameter; and a fourth sheave having a fourth diameter larger than the third diameter and coupled to said surface engaging means such that when said fourth sheave is caused to be turned said surface engaging means moves along an operating surface; and a second endless belt entrained over said third sheave and said fourth sheave.

11. The device of claim 10 wherein said second speed reduction assembly comprises a second spring biased lever pivotally secured to said frame means and a second idler sheave rotatably secured to said second spring biased lever and engaged to said second endless belt.

* * * * *